United States Patent [19]

Bush

[11] 4,423,423

[45] Dec. 27, 1983

[54] BROAD BANDWIDTH FOLDED DIPOLE ANTENNA

[75] Inventor: Elmer R. Bush, Bethlehem, Pa.

[73] Assignee: L. Barker & Williamson, Inc., Bristol, Pa.

[21] Appl. No.: 298,140

[22] Filed: Aug. 31, 1981

Related U.S. Application Data

[63] Continuation-in-part of Ser. No. 185,451, Sep. 9, 1980, abandoned.

[51] Int. Cl.[3] ..... H01Q 9/26

[52] U.S. Cl. ..... 343/803; 343/822

[58] Field of Search ..... 343/803, 804, 886, 821, 343/822

[56] References Cited

U.S. PATENT DOCUMENTS 2,258,407 10/1941 Carter ..... 343/803

2,283,938 5/1942 McKesson ..... 343/803

FOREIGN PATENT DOCUMENTS 500162 2/1939 United Kingdom ..... 343/739

*Primary Examiner*—E. Lieberman

*Attorney, Agent, or Firm*—Seidel, Gonda & Goldhammer

[57] ABSTRACT

A folded dipole antenna system for use in the transmission reception of radio frequency energy by a radio frequency generator capable of continuous operation over an entire extremely broad bandwidth while maintaining an effective radiated power factor and a substantially linear visual standing wave ratio of less than 2 to 1 for each frequency over the entire operational bandwidth. The antenna system exhibits a substantially shortened overall length which is proportional to the entire operational bandwidth.

7 Claims, 13 Drawing Figures

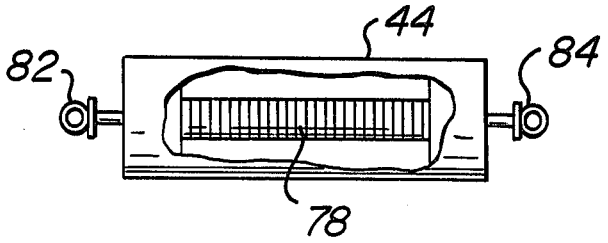
FIG. 9
FIG. 10
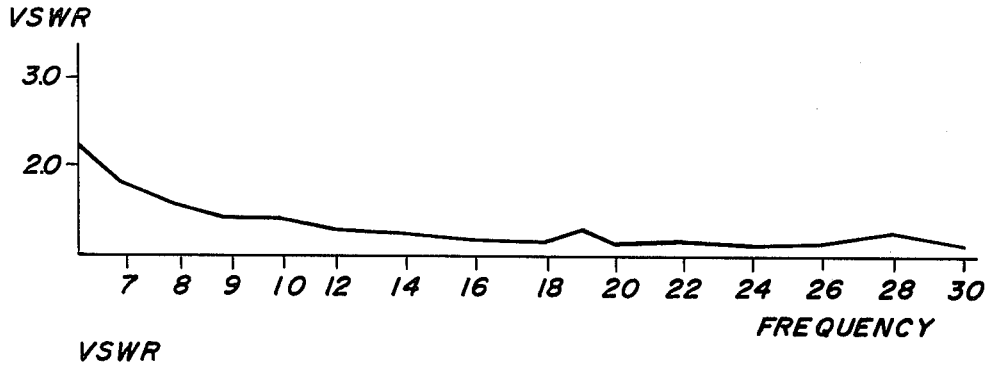
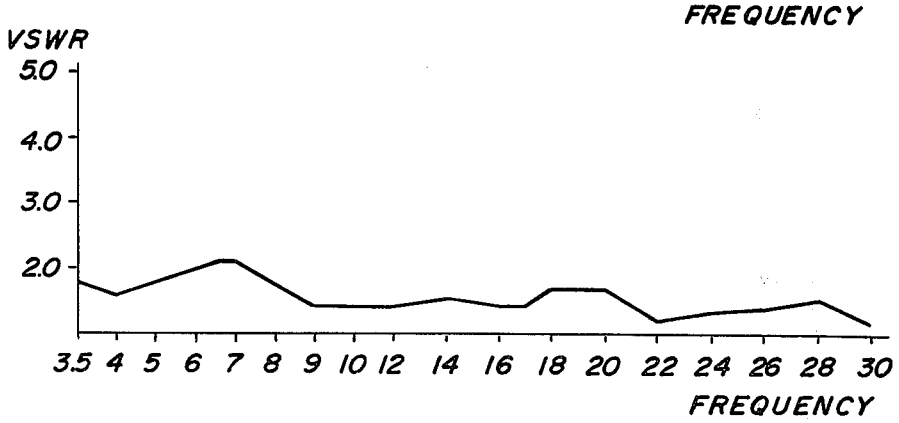
FIG. 11

BROAD BANDWIDTH FOLDED DIPOLE ANTENNA

This is a continuation-in-part of application Ser. No. 185,451 filed Sept. 9, 1980, now abandoned.

BACKGROUND OF THE INVENTION

The folded dipole antenna of the present invention was developed to overcome certain deficiencies in existing antenna systems. This antenna has an extremely broad bandwidth in the high frequency ranges (1.8–30 MHz) and can maintain effective radiated power using a shorter antenna span.

Most present day users of antennas for communication purposes desire an antenna to operate on multiple frequencies without having to resort to antenna tuning devices. Most antennas require tuning devices which are usually placed between the radio frequency transmitter and the antenna to properly tune the antenna to match the desired broadcast frequency. Another requirement, or rather a problem, is that the antenna must be capable of fitting into the space available. In many instances, such as roof top installations, the space available is quite short and will not be able to accommodate antennas of extreme overall length. Further, in various localities, e.g. foreign countries, frequency allocations can be changed without prior notice. This would put the user virtually in a position where he can no longer operate his communications facility.

In the past, trap dipole antennas have been used to alleviate some of the above conditions and problems. The use of the trap dipole antennas has resulted in somewhat poor to unsatisfactory operating conditions of the communications systems because of narrow bandwidths typical to this type of antenna. In many cases the user requires a preassembled antenna for use on certain frequencies. However, due to differing conditions at the point of installation, i.e. height above ground, ground conditions, surrounding objects, etc., it is not always possible to preassemble an antenna in a factory which will work effectively in all desired locations.

The trap-type antennas were designed to be able to receive and transmit over certain designated frequencies selected by the user. This was accomplished by creating artificial antenna electrical lengths shorter than the entire length of the antenna so that the antenna would look either shorter or longer to the radio frequency generator. This enabled the user to transmit or receive over certain frequencies located at selected points along the frequency spectrum. However, this limited the user to only those specific frequencies because of the narrow bandwidths of this type antenna. The trap-type antenna was not capable of operating over its entire frequency range.

Antenna tuning devices have also been used to assist trap-type antennas to attain certain frequencies in adverse environmental conditions. This is because the traps will vary in frequency due to temperature, humidity and other environmental conditions. Therefore, a trap-type antenna which has been designed for operation on certain frequencies and preassembled in a factory will, even though tuned for specific frequencies, change considerably once it is installed at its location. The frequency changes will then necessitate the use of an antenna tuning device which may or may not be capable of bringing the antenna back to the desired characteristics.

SUMMARY OF THE INVENTION

The present invention was designed and developed to eliminate the above problems and conditions. The broad bandwidth folded dipole antenna of the present invention exhibits an extremely broad continuous bandwidth which will overcome the above problems while maintaining an effective radiated power factor and a substantially linear voltage standing wave ratio over a frequency range of 1.8 to 30 MHz. The specific frequency range will depend upon the length and arrangement of the antenna elements.

The folded dipole antenna of the present invention comprises two conducting wires with each wire folded back over itself in a spaced parallel relationship. The ends of these folded wires are arranged so that like ends oppose each other. A load balancing means joins together one set of these opposing ends of the folded conducting wires. A load matching means connects the remaining set of opposing ends through the matching means to a radio frequency generator. The antenna which is of a substantially shortened overall length is then capable of operating over an extremely broad continuous frequency, e.g. 1.8 to 30 MHz, while maintaining a substantially linear voltage standing wave ratio of less than 2:1 over the entire bandwidth.

In certain unusual conditions a high voltage standing wave ratio may be encountered on some frequencies. These conditions include but are not limited to surrounding objects, such as buildings, power lines, metallic objects, etc., and ground conditions which vary considerably depending upon the water content of the ground in the immediate vicinity of the antenna. Whether the antenna is installed in jungle or swamp conditions where the water table is at or just below ground level or in desert conditions where the water table is many feet below the surface affects the antenna and along with surrounding objects will cause a high voltage standing wave ratio on some frequencies. This can be corrected by connecting tuning means between the legs of each of the folded conducting wires for reducing the voltage standing wave ratio associated with those affected frequencies to a voltage standing wave ratio more closely approaching unity thus increasing the usable frequency range.

An object of the present invention is to design an antenna which is capable of operating over an extremely broad continuous frequency range.

A further object of the present invention is to design an antenna which has built-in tuning means for reducing the voltage standing wave ratio at certain frequencies to the voltage standing wave ratio of the antenna over the entire bandwidth so as to make that specific frequency usable for transmission and reception.

Another object of the present invention is to design a broadband antenna, which is capable of operating over a frequency range of 1.8 to 30 MHz, having a substantially shorter overall length than antennas operable on similar frequencies.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 9 is a partially cutaway view of the antenna balancing means of the present invention showing the internal structure and the connecting means.

FIG. 10 is a graphical representation of the visual standing wave ratio curve for a folded dipole antenna of the present invention having a length of 50 feet with 18 inch spreaders over a frequency range of 7–30 MHz.

FIG. 11 is a graphical representation of the visual standing wave ratio curve for a folded dipole antenna of the present invention having a length of 90 feet with 18 inch spreaders over a frequency range of 3.5–30 MHz.

DETAILED DESCRIPTION OF THE INVENTION

Figure 1:
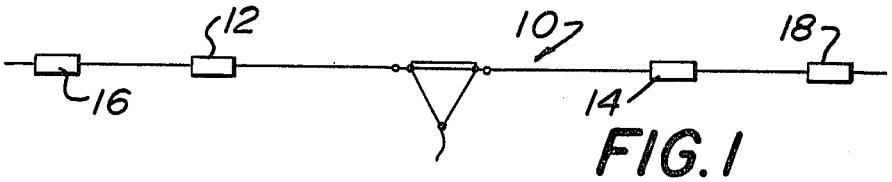
FIG. 1 (PRIOR ART)
FIG. 1 is a side elevational view of a dipole antenna as presently existing showing a trap on either side of the center connector feed point.
Figure 2:
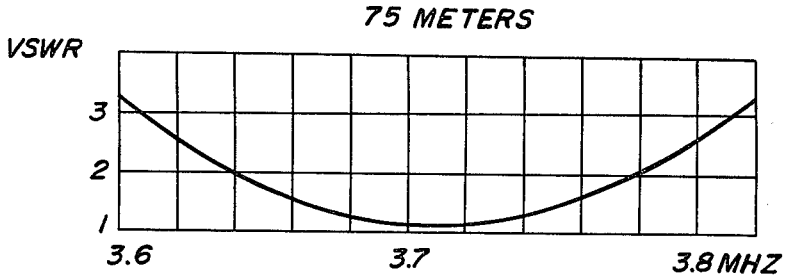
FIG. 2 (PRIOR ART)
FIG. 2 is a graphical representation of a typical visual standing wave ratio curve for the antenna of FIG. 1 over a frequency range of 3.6 to 3.8 MHz.

The present invention is best understood by referring to the drawings wherein like numerals indicate like elements. Referring to FIGS. 1 and 2 there is shown a prior art dipole antenna 10 having an overall length of 127 feet for use with a frequency of approximately 3.7 MHz. The antenna 10 has two traps 12, 14 to enable the antenna to transmit and receive multiple frequencies. Two end insulators 16, 18 serve as a terminus of each antenna leg and insulate the antenna from the lines used to support it. Prior dipole antennas had bandwidths of only 100 to 500 KHz. In order to get a broad bandwidth antenna responsive to multiple frequencies a trap dipole antenna was introduced. The length of the antenna between the connection at its center and the trap would correspond to a wave length division of the actual frequency, i.e., $\frac{1}{4}$, $\frac{3}{8}$, $\frac{1}{2}$, etc. In this manner a single length of antenna could receive multiple frequencies on shortened legs of its entire length. Each of these legs will correspond to a given frequency but, as the length of the leg and the frequency increase, the bandwidth decreases from 100 KHz to approximately 25 KHz or less. This decrease in bandwidth corresponds to the voltage standing wave ratio (VSWR) being linear for frequencies across the selected band. Outside of the 25 KHz bandwidth the voltage standing wave ratio increases parabolically away from the heat response of a 1:1 ratio to one extremely less desirable.

The graph in FIG. 2 shows the voltage standing wave ratio curve for the trap dipole antenna of FIG. 1 for frequencies of approximately 3.7 MHz. It should be noted that in order for a frequency to be usable for transmission and reception the voltage standing wave ratio of a communication system's antenna for that frequency should approach a one to one ratio. The farther away from such a one to one ratio the less usable the frequency. If the ratio exceeds a relationship of 3:1 the performance of the antenna at that frequency will no longer be deemed satisfactory. In the graph of FIG. 2 the most usable frequencies would be closer to 3.7 MHz. The frequencies approaching 3.6 and 3.8 MHz become more and more unusable as the voltage standing wave ratio increases and becomes less linear. In practice, a voltage standing wave ratio greater than 3:1 renders that frequency virtually unusable for transmission and reception.

Figure 3:
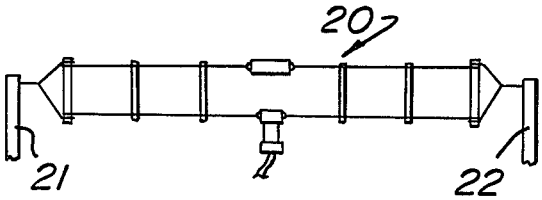
FIG. 3 is a side elevational view of the antenna of the present invention disposed in a horizontal configuration.
Figure 4:
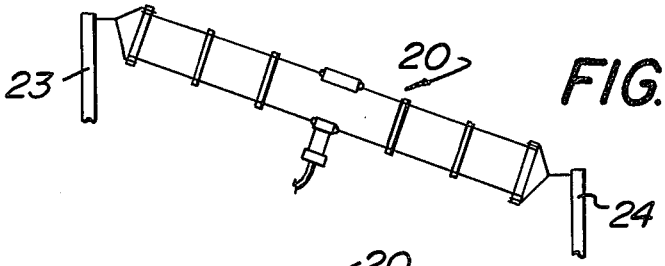
FIG. 4 is a side elevational view of the antenna of the present invention disposed in a sloping configuration.
Figure 5:
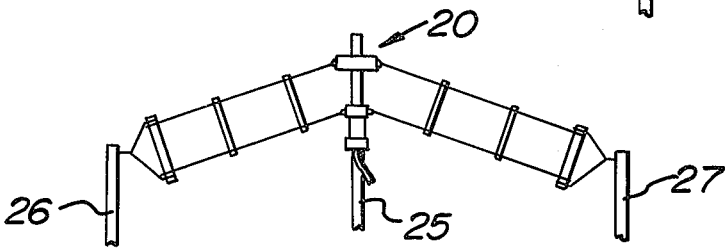
FIG. 5 is a side elevational view of the antenna of the present invention disposed in an inverted V configuration.

FIGS. 3, 4 and 5 are presented to show different mounting arrangements for the embodiments of the present invention. FIG. 3 shows the antenna 20 of the present invention disposed horizontally to the ground between two vertical poles 21, 22. FIG. 4 shows the antenna 20 in a sloping arrangement between similar vertical poles 23, 24. The antenna 20 can also be mounted in an inverted V configuration, as shown in FIG. 5, where the center point of the antenna 20 is raised approximately 15 feet higher than the ends. The center point is attached to a vertical pole 25 and the ends are attached to vertical poles 26, 27. It should not be construed as a limitation of the present invention that the configurations shown in FIGS. 3, 4 and 5 are the only arrangements in which the antenna will operate. The antenna 20 will function effectively in other arrangements, e.g., a substantially vertical configuration, or a V-type configuration, or sloping in the other direction, or sloping at greater or lesser angles.

The antenna 20 is preferably installed at least 15 feet above the ground. As stated above, any configuration of the fully extended antenna will render the antenna fully operable. In actuality, the configuration will depend upon the space available, the user's preference for such configuration and the desired radiation pattern.

Figure 6:
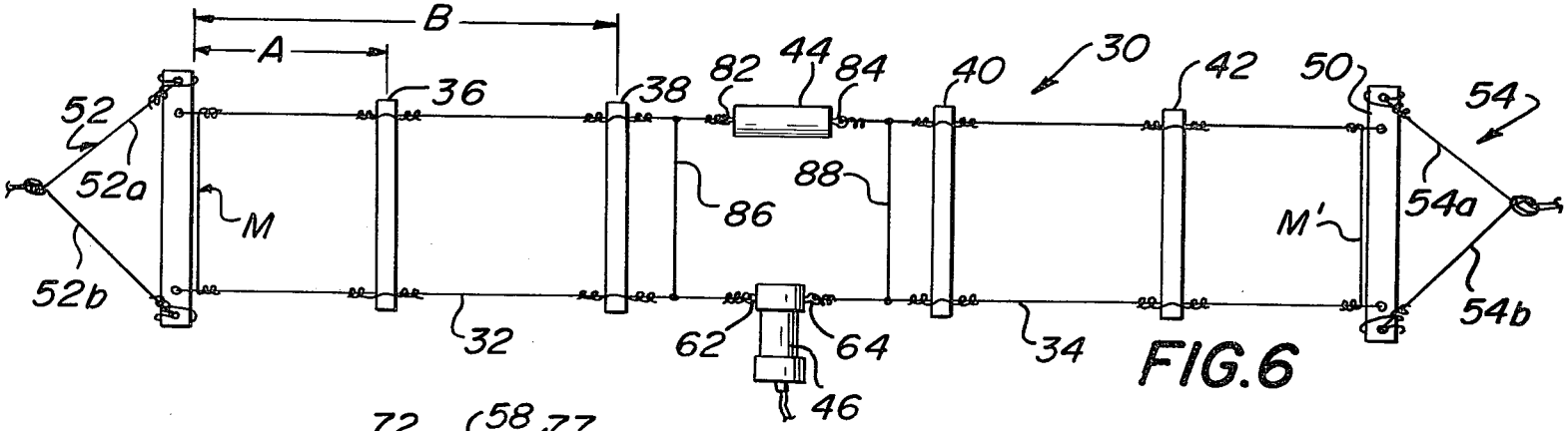
FIG. 6 is an enlarged side elevational view of one embodiment of the present invention.

Referring now to FIG. 6, an antenna, representative of one embodiment of the present invention, designated generally as 30, is shown in a fully extended horizontal configuration. The antenna 30 has similar conducting wires 32, 34 each of which is folded back over itself in a spaced parallel relationship. These wires 32, 34 are supported by spreaders 36, 38, 40 and 42 of a nonconductive material so as to maintain the wires at a spaced distance of approximately 18 inches. The conducting wires 32, 34 are held in a fixed manner to the spreaders 36–42 by the use of nonconductive securing wires which are coiled or twist-wrapped about the antenna wires. The nonconducting securing wires may also be affixed to the antenna wires by soldering or by the other equivalent means known in the mechanical arts. The two conducting wires 32, 34 are disposed so as like ends of the wires oppose one another. An antenna balancing means 44 joins together one set of opposing ends of the conducting wires 32, 34. The remaining set of opposing ends is connected by an antenna matching means 46 through which the conducting wires 32, 34 are connected to a radio frequency generator (not shown). Both the antenna balancing means 44 and the antenna matching means 46 will be more fully discussed hereinafter.

The conducting wires 32, 34 are supported on their distal ends by end spreaders 48, 50. The end spreaders 48, 50 are in turn supported by lines 52, 54 to secure the antenna 30 to its vertical supports. These supports may be any available means in the vicinity of the installation of the antenna, e.g. trees, sides of buildings, utility poles, etc. It is preferred that the antenna be installed at an average height of 25 to 40 feet above the ground. Mounting the antenna at a height above the ground of less than 15 feet has been found to be unacceptable.

The antenna 30 while shown in a substantially vertical orientation may also be installed entirely in a horizontal plane with relation to the ground. In order to have the antenna hang in the substantially vertical orientation as shown in FIG. 6, the upper legs 52*a*, 54*a* of the lines 52, 54 should be one to two inches shorter in length than the lower legs 52*b*, 54*b*.

The conducting wires 32, 34 are attached to each end spreader 48, 50 by nonconductive securing wires which are coiled or twist-wrapped about the antenna wires in a manner similar to that described above. The end spreaders 48, 50 hold the conducting wires 32, 34 in the same spaced parallel relationship as the spreaders 36–42 with the short vertical connecting legs of each of the conducting wires held in spaced parallel relation to the end spreaders 48, 50 and at right angles to the horizontal legs of the conducting wires.

The spreaders 36–42 are placed along the length of the antenna so that the legs of the conducting wires 32, 34 are kept at substantially equal distances from one another. While the spreaders 36–42 may be placed at any points along the length of the antenna 30 so as to keep the legs of the conducting wires 32, 34 in equal spaced parallel relationship, it is preferred that spreaders 36 and 42 are disposed a distance A from the distal ends of the antenna 30. Further, it is preferred that the spreaders 38 and 40 are disposed a distance B from the distal ends of the antenna 30. These preferred distances will vary depending upon the overall length of the antenna. If the overall length of the antenna 30 is, for example, 50 feet, then the distances A, B are 10 feet 8 inches and 22 feet 5 inches respectively. If the antenna 30 has an overall length of 90 feet, so as to be capable of receiving slightly lower frequency, the distances A, B would be 20 feet and 41 feet respectively.

The overall length of the antenna is dependent upon the desired frequency range and the space available at the installation site. An antenna in accordance with the present invention for use over a continuous frequency range between 3.5 and 30 MHz will have an overall length which can vary between 50 and 130 feet. If the antenna is shortened to a length less than 50 feet, the lower frequencies may become unusable due to a loss in the effective radiated power of the antenna for those frequencies. If the antenna is lengthened, the frequency range will increase at the lower end but, the higher frequencies may become unusable due to a similar loss in the effective radiated power of the antenna for those frequencies. An overall length of 90 feet was selected for the antenna since that length gave the best performance over the desired frequency range. While antennas of shorter lengths, such as 65 feet, can be constructed and made to respond satisfactorily to accommodate special requirements, the 90 foot length is preferred. For a different continuous frequency range, such as between 7 and 30 MHz, an antenna in accordance with the present invention will vary between 30 and 70 feet in overall length. If the antenna is either shortened or lengthened beyond the stated range, it will respond similarly to the 90 foot antenna in that the frequency range will narrow due to loss of effective radiated power over the frequencies at the extreme ends of the range. A length of 50 feet is preferred since that length gives the best performance over the desired frequency range.

Figure 7:
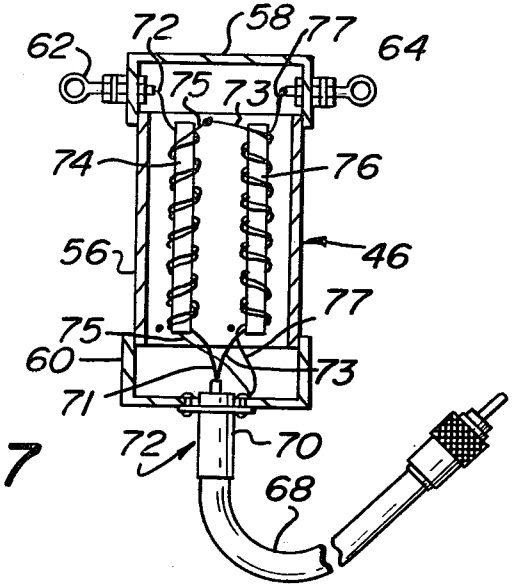
FIG. 7 is a cut away view of the antenna matching means of the present invention showing the internal structure and connecting means.

Returning to the description of the elements of antenna 30, the antenna or load matching means 46 is shown more clearly in an enlarged cutaway view in FIG. 7. The antenna matching means 46 is housed in a substantially tube-like fiberglass casing 56 having end caps 58, 60 secured to the casing to form a weathertight seal by any means known in the mechanical arts such as by threadedly securing, press fitting, glueing, etc. Although fiberglass is the preferred material for casing 56, metal, plastic or materials of similar hardness may be used provided a weathertight seal can be accomplished with such material. The end cap 58 has two eyebolts 62, 64 extending through its outer circumference. The eyebolts 62, 64 are axially aligned along their lengthwise direction and insulatively secured to the end cap 58 by any known mechanical means such as by using lock washers and nuts insulated from the cap 58 by plastic inserts and washers. The conducting wires 32, 34 are attached to the eyebolts 62, 64 respectively to provide connection to the antenna 30.

The other end cap 60 is provided with a cable connection 72 through the center of its flat side. The cable connection 72 is a fixed connection for receiving a standard 50 ohm coaxial cable 68 surrounded by strain relief 70. The other end of the coaxial cable 68 is fitted with a suitable connector, such as a PL259 connector, for connection to either an intermediate cable of the same type or directly to a radio frequency generator. The coaxial connector 72 is secured to the end cap 60 by any known mechanical means such as by using bolts with lock washers and nuts or rivets.

Figure 8:
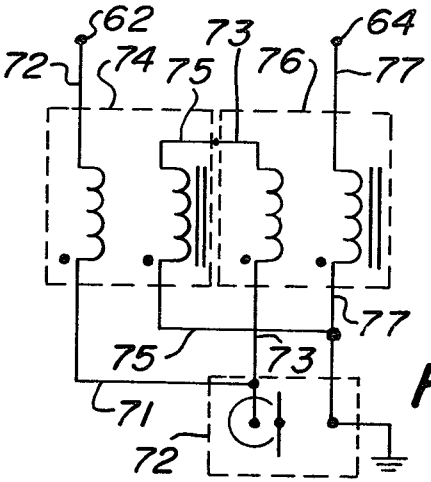
FIG. 8 is a schematic illustration of the electrical circuit of the antenna matching means of the present invention.

Disposed laterally to the tube-like fiberglass casing 56 of the antenna matching means 46 are two coils 74, 76. The coils 74, 76 are disposed in spaced parallel relationship along the longitudinal axis of the tube-like fiberglass casing 56 and connected by wires to the eyebolts 62, 64 and the coaxial connector 72. The conducting lead or signal wire of the coaxial cable 68 as connected through the connector 72, is connected to both coils 74, 76 through wires 71, 73 beginning at the ends more adjacent to the coaxial connector 72 and wound around the coils 74, 76 a predetermined number of turns. Also wound around the coil 74, 76 are wires 75, 77 which are traceable back to the shield of the coaxial cable 68. These wires 75, 77 are also connected to the noninsulating mounting of the coaxial connector 72 and thus to the shield of the cable 68. At the distal end of coil 74 wire 72, which can be traced back to the conductor of the coaxial cable 68, is connected to the eyebolt 62. In addition, wire 75, which can be traced back to the shield of the coaxial cable 68 is connected to the wire 73 wrapped around coil 76 which can be traced back to the conductor of coaxial cable 68. Further, at the distal end of coil 76 wire 77, which can be traced back to the shield of coaxial cable 68, is connected to the eyebolt 64. These connections can be made using any means known per se in the mechanical arts such as soldering either to the desired surface or to metal lugs provided for such attachment or by clamping, etc. The two coils 74, 76 are wound a predetermined number of turns to create a ratio of the windings of one coil to the windings on the other coil. This ratio provides the necessary balancing between the output impedance of the radio frequency generator and the load impedance of the antenna 30. A schematic of the circuit of the antenna matching means 46 is shown in FIG. 8. The wiring and external connection points are numbered to correspond to the elements of the antenna matching means 46 described above.

The above description of the antenna matching means 46 is that of the preferred type. It should be noted that the antenna matching means 46 is a special type of transformer or balun which converts either a balanced electrical system to an unbalanced system or an unbalanced electrical system to a balanced system. These types of balun transformers have been designed in all sizes and shapes from the midget "ladder" transformer used in television receiving antennas to giant multi-kilowatt units used with commercial broadcasting antennas. The balun described above is a variation of a stick-type balun commonly available. However, the use of a modified stick-type balun in describing the invention should not be considered as limiting the construction of the antenna to this particular structure. Other baluns, such as a core-type balun, may be substituted for the antenna matching means 46 in the antenna system of the present invention with similar results.

The antenna matching means or balun 46 is used in the antenna system of the present invention to create a balanced antenna system from an unbalanced coaxial feedline such as cable 68. Placing the antenna matching means 46 between the coaxial cable 68 and the balanced antenna, specifically at the antenna connection, permits the coaxial line to transport radio energy from one place to another without becoming part of the antenna itself.

The antenna or load balancing means 44 which is shown in an enlarged partially cutaway view in FIG. 9, is preferably a non-inductive resistive network for matching the load of the two halves of the dipole antenna 30 of the present invention. This non-inductive resistive network may be constructed of a plurality of resistors or a single wire wound resistor 78 can be used. The resistor 78 is disposed within the tubular casing 80 of the antenna matching means 44. Eyebolts 82, 84 are axially aligned along their lengthwise direction similar to eyebolts 62, 64 and extend through the center of the ends of the tubular casing 80. The eyebolts 82, 84 are insulatively mounted to the casing 80 by any mechanical means known in the art such as plastic insulator rings secured by lock washers and nuts. The internal ends of the eyebolts 82, 84 are connected to the non-inductive resistive network 78, again, by any mechanical means known in the art such as by direct soldering, soldering the resistor leads to metal lugs secured to the eyebolts, etc.

The non-inductive resistive network 78 is preferably a single wire wound resistor having an impedance dependent upon the selected frequency range of the antenna. This impedence must be totally non-inductive for the antenna to function properly. The resistive network 78 must also have a power dissipation capability which should be at least one quarter of the power transferred through the antenna matching means 46 to the antenna from the radio frequency generator. Of course, in order that the environment not affect the operation of the resistive network 78 the casing 80 should be weather proof.

The antenna balancing or load impedance is chosen to give the antenna its broad band characteristics while retaining its shorter overall length. It has been found that a load impedance in the range of 100–900 ohms will work satisfactorily with an antenna having a frequency range of 3.5–30 MHz and an overall length between 50 and 130 feet. A load impedance of 600 ohms is preferred because it increases the bandwidth of the antenna while decreasing the voltage standing wave ratio associated with each frequency in the 3.5–30 MHz range. Since the output impedance of the radio frequency generator is most often 50 ohms, the ratio between the two coils 74, 76 of the antenna matching means 46 will be 12:1. The antenna load impedance of 600 ohms works equally well with a frequency range of 7.0–30 MHz. However, for bandwidths which include lower frequencies, such as 1.8 MHz, and for other frequency ranges of smaller bandwidths, other impedances in the range of 100–900 ohms may be preferred in order to decrease the voltage standing wave ratio for those frequencies while permitting transmission and reception over a continuous bandwidth. With the use of a smaller impedance in the antenna balancing means 44, the ratio of the coils 74, 76 in the antenna matching means 46 and the length of the antenna will vary to reflect such changes.

Referring now to FIGS. 10 and 11, each of the graphs shows the voltage standing wave ratio (VSWR) measured at the designated frequency. The graphs quite clearly show that for a continuous frequency range between 3.5 or 7 and 30 MHz the VSWR is substantially linear and never exceeds a ratio of 2:1. Thus, the folded dipole antenna system of the first embodiment of the present invention exhibits the characteristic of being capable of transmitting and receiving over any frequency in its extremely broad frequency range.

If, for example, a user sought to broadcast at or near 7 MHz in a location which might be deemed undesirable due to power lines, adjacent steel structures, or ground conditions, antenna tuning means 86, 88 can be added to the antenna structure. See FIG. 6. The tuning means 86, 88 are actually tuning stubs or bars located outward from the feed point of the antenna approximately 17 to 20 inches depending on the desired frequency. These tuning stubs 86, 88 are connected in a perpendicular manner between and directly to the legs of the folded conducting wires 32, 34. This attaching may be accomplished by any mechanical means known in the art such as by clamping, splicing, etc. The addition of the tuning stubs 86, 88 converts the dual element folded dipole antenna 30 to a multiple element dipole antenna tuned to certain frequencies. The placement of the tuning stubs changes the current phasing in the antenna conducting wires 32, 34. Current cancellation will occur at the midpoint of the wires 32, 34, denoted by M, M′, and reflected uncancelled power will appear in the antenna balancing means 44. The placement of the tuning stubs 86, 88 is very important. They must be placed so that the current at the desired frequency has a 180° phase difference at the midpoints M, M′. The tuning stubs 86, 88 also act to convert the antenna 30 into a modified complementary dipole by coupling the signal to a fixed impedance in the antenna balancing means 44 with each wire 32, 34 being in electrical parallel relationship to the tuning stubs. The antenna balancing means 44 establishes a fixed load across the source and absorbs the unradiated power. The tuning stubs 86, 88 react with the antenna balancing means 44 to control the phase of the signal and cause the balancing means to modify the impedance of each wire 32, 34 thus stabilizing the impedance and decreasing the visual standing wave ratio at the desired frequency. Therefore, the voltage standing wave ratio (VSWR) is reduced, in the case of our example, from approximately a ratio of 2:1 to a ratio more closely approaching unity. The tuning stubs 86, 88 thus reduce a higher voltage standing wave ratio of the selected frequency making the resulting plot of the voltage standing wave ratio over the entire frequency spectrum of the antenna sustantially more linear.

Figure 12:
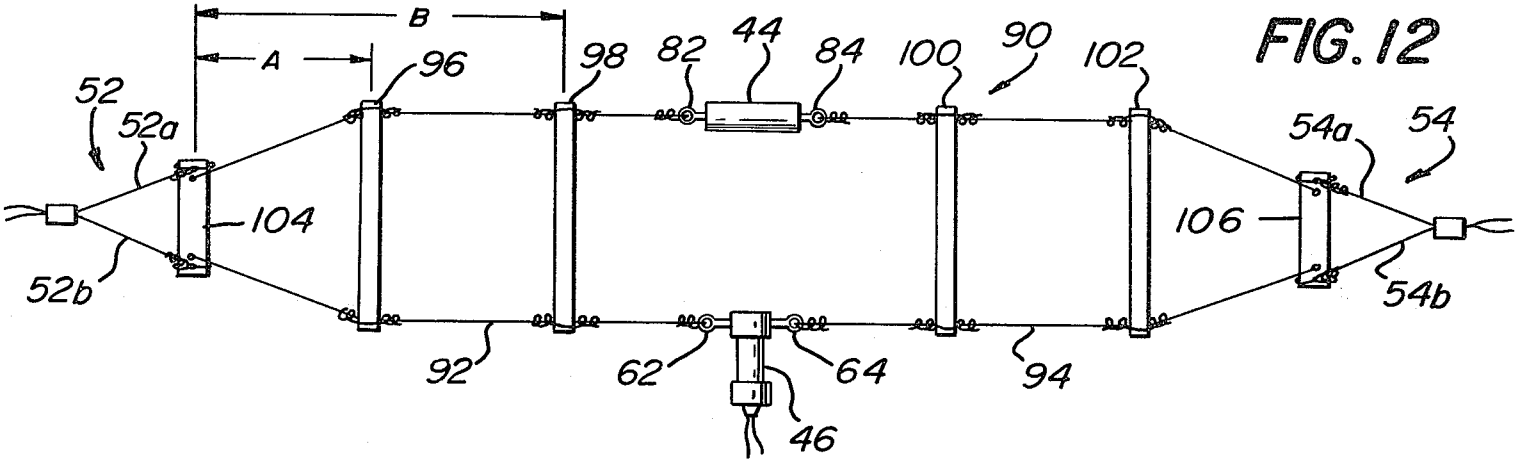
FIG. 12 is an enlarged side elevational view of a second embodiment of the present invention.

Referring to FIG. 12, there is shown another embodiment representative of the present invention, designated generally as 90, in a fully-extended horizontal configuration. The antenna 90 has similar conducting wires 92, 94 each of which is folded back over itself in a spaced parallel relationship. These wires 92, 94 are supported by spreaders 96, 98, 100, and 102 of a non-conductive material so as to maintain the wires at a spaced distance of approximately 36 inches. The distal ends of the wires 92, 94 are tapered inward toward each other and supported by end spreaders 104, 106. The end spreaders 104, 106 retain the wires at a spaced distance of approximately 18 inches. The end spreaders 104, 106 are in turn supported by lines 52, 54 to secure the antenna 90 to its supports in a manner similar to that described above. In order to have the antenna 90 hang in the substantially vertical position as shown in FIG. 12, the upper legs 52*a*, 54*a* of the lines 52, 54 should be one to two inches shorter than the lower legs 52*b*, 54*b*. Of course the antenna may also be installed in other orientations dependent upon the vicinity of the installation and the desired radiation pattern.

The conducting wires 92, 94 are held in a fixed manner to the spreaders 96–106 by the use of non-conductive securing wires which are coiled or twist-wrapped about the antenna wires. These securing wires may also be affixed to the antenna wires by other equivalent means as discussed above. The end spreaders 104, 106 permit the conducting wires 92, 94 to taper toward one another from their spaced parallel relationship of approximately 36 inches so that the wires are approximately 18 inches apart. The end spreaders 104, 106 also retain the short vertical connecting legs of each of the conducting wires in spaced parallel relation to the end spreaders 104, 106 and at similar obtuse angles to the distal portions of the conducting wires.

The spreaders 96–102 are placed along the length of the antenna so that the legs of the conducting wires 93, 94 are kept at substantially equal distances from one another. While the spreaders 96–102 may be placed at any points along the length of the antenna 90 so as to keep the legs of the conducting wires 92, 94 in equal spaced relationship, it is preferred that spreaders 96, 102 are disposed a distance A from the distal ends of the antenna 90. Further, it is preferred that the spreaders 98, 100 are disposed a distance B from the distal ends of the antenna 90. As in the first embodiment, these preferred distances will vary depending upon the overall length of the antenna. It is preferred that the overall length of the antenna 90 is 185 feet since that length gives the best performance over the desired frequency range. Thus the distances A, B will be 30 feet and 61 feet respectively. The required length for a standard one-half wave dipole antenna is approximately 200 feet with a frequency of 1.8 MHz.

The two conducting wires 92, 94 are disposed so that like ends of the wires oppose one another. An antenna balancing means 44, such as that described above, joins together one set of opposing ends of the conducting wires 92, 94. The remaining set of opposing ends is connected by an antenna matching means 46 through which the conductinge wires 92, 94 are connected to a radio frequency generator (not shown). The antenna matching means 46 is of similar configuration and characteristics as the one described in connection with antenna 30. See FIGS. 7, 8, and 9.

An antenna balancing or load impedance of 800 ohms has been found to cause the antenna 90 to perform quite well where said antenna has a frequency range of 1.8–22 MHz and an overall length averaging 185 feet. The 800-ohm load impedance is preferred because it increases the bandwidth of the antenna while decreasing the voltage standing wave ratio associated with each frequency in the 1.8–22 MHz range. This impedance increases the ratio between the antenna matching means and output impedance of the radio frequency generator to 16:1.

Figure 13:
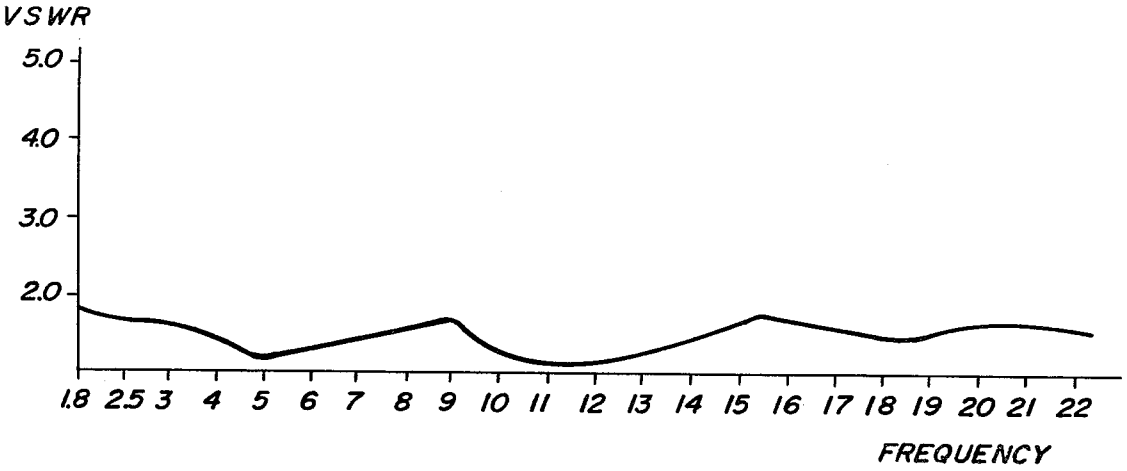
FIG. 13 is a graphical representation of the visual standing wave ratio curve of a folded dipole antenna of the present invention having a length of 185 feet with 36 inch spreaders tapering to 18 inch spreaders over a frequency range of 1.8–22 MHz.

There is shown in FIG. 13 a graph of the voltage standing wave ratio (VSWR) measured at the designated frequencies for the antenna 90. The graph again clearly shows that, for a continuous frequency range between 1.8 and 22 MHz, the VSWR is substantially linear and does not exceed a ratio of 2:1. Therefore, the folded dipole antenna system of the second embodiment of the present invention also exhibits the characteristic of being capable of transmitting and receiving over any frequency in its extremely broad frequency range.

Thus the antenna systems of the present invention have solved the existing problems with standard dipole and trap dipole antennas where only certain selected frequencies can be used because of the limitation of a maximum bandwidth of approximately 500 KHz. The antenna systems of the present invention make available the entire frequency spectrum within the selected bandwidth of an antenna to the user without having to resort to external antenna tuners or separate antennas for different frequencies.

In addition, the antenna systems of the present invention require a shorter overall length for receiving and transmitting over their broad range of frequencies, 50, 90 or 185 feet as opposed to 127 feet and longer with the dipole antennas currently in use for those frequencies between 1.8 and 30 MHz.

The present invention may be embodied in other specific forms without departing from the spirit or essential attributes thereof and, accordingly, reference should be made to the appended claims, rather than to the foregoing specification, as indicating the scope of the invention.

I claim:

1. A folded dipole antenna for use in the transmission and reception of radio frequency energy by a radio frequency generator capable of continuous operation over an entire extremely broad bandwidth while maintaining an effective radiated power factor and a voltage standing wave ratio of less than 2:1 for all frequencies over the entire operational bandwidth comprising:

(a) two conducting wires, each wire folded in spaced parallel relation to itself with like ends of each leg of said conducting wires being positioned in opposition to each other exhibiting an overall length proportional to the entire operational bandwidth;

(b) load balancing means electrically connecting one set of opposed ends of said wires;

(c) load matching means electrically connecting the remaining set of opposed ends of said wires by a single feed line to a radio frequency generator;

(d) said load balancing means and said load matching means requiring no variations of their electrical properties by any external means when tuning the radio frequency generator from one frequency to another frequency over the entire frequency spectrum of the antenna in order to maintain the substantially constant radiating characteristics of said antenna;

(e) the distal portion of each of the folded legs of the conducting wires tapering inward toward the other folded leg of the same conducting wire to a distance of one-half the spaced parallel distance between said folded legs over the remaining length of the antenna.

2. A folded dipole antenna in accordance with claim 1 wherein the overall length of the antenna lies in the range between 50 and 103 feet, the entire operational bandwidth including all frequencies in the range between 3.5 and 30 MHz.

3. A folded dipole antenna in accordance with claim 1 wherein the overall length of the antenna lies in the range between 30 and 70 feet, the entire operational bandwidth including all frequencies in the range between 7.0 and 30 MHz.

4. A folded dipole antenna in accordance with claim 1 wherein the overall length of the antenna lies in the range between 170 and 200 feet, the entire operational bandwidth including all frequencies in the range between 1.8 and 22 MHz.

5. A folded dipole antenna for use in the transmission and reception of radio frequency energy by a radio frequency generator capable of continuous operation over an entire extremely broad bandwidth while maintaining an effective radiated power factor and a voltage standing wave ratio of less than 2:1 for all frequencies over the entire operational bandwidth comprising:

(a) two conducting wires, each wire folded in spaced parallel relation to itself with like ends of each leg of said conducting wires being positioned in opposition to each other exhibiting an overall length proportional to the entire operational bandwidth;

(b) load balancing means electrically connecting one set of opposed ends of said wires;

(c) load matching means electrically connecting the remaining set of opposed ends of said wires by a single feed line to a radio frequency generator;

(d) said load balancing means and said load matching means requiring no variations of their electrical properties by any external means when tuning the radio frequency generator from one frequency to another frequency over the entire frequency spectrum of the antenna in order to maintain the substantially constant radiating characteristics of said antenna;

(e) tuning means connected between the legs of each of said folded wires for reducing the voltage standing wave ratio associated with at least one specific frequency to a voltage standing wave ratio of less than 2:1.

6. A folded dipole antenna in accordance with claim 5 wherein said tuning means are stubs or bars spaced equal distances outward of the center feed point of said antenna along the legs of said folded wires, said distances proportional to the specific frequency.

7. A folded dipole antenna in accordance with claim 6 wherein said distances are between 17 and 20 inches.

* * * * *